United States Patent [19]

Wilks

[11] 3,964,935

[45] June 22, 1976

[54] ALUMINUM-CERIUM-IRON ELECTRICAL CONDUCTOR AND METHOD FOR MAKING SAME

[75] Inventor: Van C. Wilks, Carrollton, Ga.

[73] Assignee: Southwire Company, Carrollton, Ga.

[22] Filed: Oct. 7, 1974

[21] Appl. No.: 512,821

Related U.S. Application Data

[63] Continuation-in-part of Ser. No. 240,794, April 3, 1972, abandoned.

[52] U.S. Cl. ..... 148/2; 29/193; 29/527.7; 75/138; 75/147; 148/11.5 A; 148/32; 164/76

[51] Int. Cl.[2] ..... C22F 1/04

[58] Field of Search ..... 75/138, 147; 29/193, 29/193.5, 527.7; 148/11.5 A, 2, 32, 32.5; 164/76

[56] References Cited

UNITED STATES PATENTS

| | | | |
|---|---|---|---|
| 3,278,300 | 10/1966 | Koike | 75/138 |
| 3,615,371 | 10/1971 | Nakajima et al. | 75/147 |
| 3,811,846 | 5/1974 | Schoerner et al. | 75/138 |

*Primary Examiner*—R. Dean
*Attorney, Agent, or Firm*—Van C. Wilks; Herbert M. Hanegan; Stanley L. Tate

[57] ABSTRACT

Aluminum alloy electrical conductors are produced from aluminum base alloys consisting essentially from about 0.20 percent to about 1.50 percent by weight cerium, from about 0.55 percent to about 1.2 percent by weight iron, with the further proviso that the combined weight amount of cerium and iron should range from about 1.2 percent to about 2.5 percent. Optionally magnesium and cobalt in small amounts, e.g., about 0.15 percent can be employed. The alloy conductors of the present invention have an electrical conductivity of at least 59% based on the Internatinal Annealed Copper Standard (IACS), and improved properties of increased thermal stability, ductility, fatigue resistance and yield strength as compared to conventional aluminum alloys with similar electrical properties. The preferred method employed utilizes continuous casting, e.g., casting wheel technique, followed immediately with continuous rolling to rod and/or wire.

10 Claims, No Drawings

ALUMINUM-CERIUM-IRON ELECTRICAL CONDUCTOR AND METHOD FOR MAKING SAME

This application is a continuation-in-part of U.S. application Ser. No. 240,794, filed Apr. 3, 1972, now abandoned.

DESCRIPTION OF PREFERRED EMBODIMENT

The present invention concerns an aluminum base alloy especially suited for producing high-strength, light-weight electrical conductors including wire, rod and other such articles of manufacture as well as the method for making same. The present alloy is particularly well suited for use as a wire, rod, cable, bus bar, tube connector, termination, receptacle plug or electrical contact device for conducting electricity.

Aluminum base alloys are finding wider acceptance in the marketplace of today because of their light weight and low cost. One area where aluminum alloys have found increasing acceptance is in the replacement of copper in the manufacture of electrically conductive wire. Conventional electrically conductive aluminum alloy wire (referred to as EC) contains a substantial amount of pure aluminum and trace amounts of impurities such as silicon, vanadium, iron, copper, manganese, magnesium, zinc, boron and titanium.

Even though desirable in terms of weight and cost, aluminum alloys have received far less than complete acceptance in the electrical conductor marketplace. One of the chief reasons for the lack of complete acceptance is the range of physical properties available with conventional EC aluminum alloy conductors. If the physical properties, such as thermal stability, tensile strenth, percent elongation, ductility and yield strength, could be improved significantly without substantially lessening the electrical conductivity of the finished product, a very desirable improvement would be achieved. It is accepted, however, that addition of alloying elements, as in other aluminum alloys, reduces conductivity while improving the physical properties. Consequently, only those additions of elements which improve physical properties without substantially lessening conductivity will yield an acceptable and useful product.

It is an object of the present invention, therefore, to provide a new aluminum alloy electrical conductor which combines improved physical properties with acceptable electrical conductivity. These and other objects, features and advantages of the present invention will be apparent from a consideration of the following detailed description of an embodiment of the invention.

In accordance with the invention, the present aluminum alloy is prepared by mixing predetermined amounts of cerium and iron with aluminum in a furnace to obtain a melt having requisite percentages of elements. When the requisite amount of iron is included, satisfactory results are obtained with cerium present in a weight percentage of from about 0.20 percent to about 1.50 percent. Preferably, cerium is present in a percentage by weight ranging from about 0.40 percent to about 0.80 percent. Similarly, when the requisite amount of cerium is present, satisfactory results are obtained with iron present in a weight percentage of from about 0.55 percent to about 1.2 percent. Preferably, iron is present in a percentage by weight ranging from about 0.65 percent to about 1.0 percent.

It has also been found that to obtain the desired combination of physical and electrical properties enabling use of the present alloy for conductors, e.g., wire and the like, the combined amount of cerium and iron in the alloy should range from about 1.2 percent to about 2.5 percent. Thus, when the iron content is in the upper part of the range, the cerium content must necessarily be at the lower portion of its range.

The aluminum content of the present alloy is generally preferred to vary between about 98 and 99 or more percent by weight. Thus, if commercial aluminum is employed in preparing the present alloy, it is preferred that the aluminum contain no more than about 0.10 percent total of normally associated trace impurities.

Optionally, cobalt or magnesium can be added to the present aluminum-iron-cerium alloy in small amounts ranging from about 0.001 weight percent up to about 0.15 weight percent each, not to exceed a total of about 0.25 weight percent.

After preparing the melt, the aluminum alloy is preferably continuously cast into a continuous bar by a continuous casting machine and then substantially immediately thereafter, hot-worked in a rolling mill to yield a continuous aluminum alloy rod which can be formed into a wire.

It has been determined that by using the present combination of alloying elements and processing same into rod and/or wire by continuous casting followed by rolling, etc., as described in greater detail hereinafter, certain cerium and iron intermetallic compounds are formed and precipitated in the grain boundaries of the conductor to provide additional strengthening characteristics.

CONTINUOUS CASTING AND ROLLING OPERATION

A continuous casting machine serves as a means for solidifying the molten aluminum alloy metal to provide a cast bar that is conveyed in substantially the condition in which it solidified from the continuous casting machine to the rolling mill, which serves as a means for hot-forming the cast bar into rod or another hot-formed product in a manner which imparts substantial movement to the cast bar along a plurality of angularly disposed axes.

The continuous casting machine is of conventional casting wheel type having a casting wheel with a casting groove in its periphery which is partially closed by an endless belt supported by the casting wheel and an idler pulley. The casting wheel and the endless belt cooperate to provide a mold into one end of which molten metal is poured to solidify and from the other end of which the cast bar is emitted in substantially that condition in which it solidified.

The rolling mill is of conventional type having a plurality of roll stands arranged to hot-form the cast bar by a series of deformations. The continuous casting machine and the rolling mill are positioned relative to each other so that the cast bar enters the rolling mill substantially immediately after solidification and in substantially that condition in which it solidified. In this condition, the cast bar is at a hot-forming temperature within the range of temperatures for hot-forming the cast bar at the initiation of hot-forming without heating between the casting machine and the rolling mill. In the event that it is desired to closely control the hot-forming temperature of the cast bar within the conventional range of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot-form the cast bar into a rod of a cross-sectional area substantially less than that of the cast bar as it enters the rolling mill.

The peripheral surfaces of the rolls of adjacent roll stands in the rolling mill change in configuration; that is, the cast bar is engaged by the rolls of successive roll stands with surfaces of varying configuration, and from different directions. This varying surface engagement of the cast bar in the roll stands functions to knead or shape the metal in the cast bar in such a manner that it is worked at each roll stand and also to simultaneously reduce and change the cross-sectional area of the cast bar into that of the rod.

As each roll stand engages the cast bar, it is desirable that the cast bar be received with sufficient volume per unit of time at the roll stand for the cast bar to generally fill the space defined by the rolls of the roll stand so that the rolls will be effective to work the metal in the cast bar. However, it is also desirable that the space defined by the rolls of each roll stand not be overfilled so that the cast bar will not be forced into the gaps between the rolls. Thus, it is desirable that the rod be fed toward each roll stand at a volume per unit of time which is sufficient to fill, but not overfill, the space defined by the rolls of the roll stand.

As the cast bar is received from the continuous casting machine, it usually has one large flat surface corresponding to the surface of the endless band and inwardly tapered side surfaces corresponding to the shape of the groove in the casting wheel. As the cast bar is compressed by the rolls of the roll stands, the cast bar is deformed so that it generally takes the cros-section shape defined by the adjacent peripheries of the rolls of each roll stand.

Thus, it will be understood that with this apparatus, cast aluminum alloy rod of an infinite number of different lengths is prepared by simultaneous casting of the molten aluminum alloy and hot-forming or rolling the cast aluminum bar. The continuous rod has a minimum electrical conductivity of 59% IACS and may be used in conducting electricity or it may be drawn to wire of a smaller cross-sectional diameter.

To produce wire of various gauges, the continuous rod produced by the casting and rolling operation is processed in a reduction operation. The unannealed rod (i.e., as rolled to f temper) is cold-drawn through a series of progressively constricted dies, without intermediate anneals, to form a continuous wire of desired diameter. It has been found that the elimination of intermediate anneals is preferable during the processing of the rod and improves the physical properties of the wire. Processing with intermediate anneals is acceptable when the requirements for physical properties of the wire permit reduced values. The conductivity of the hard-drawn wire is at least 59% IACS. If greater conductivity or increased elongation is desired, the wire may be annealed or partially annealed after the desired wire size is obtained and cooled. Fully annealed wire has a conductivity of at least 61% IACS. At the conclusion of the drawing operation and optional annealing operation, it is found that the alloy wire has the property of improved yield strength together with improved thermal stability, increased ductility, and fatigue resistance, as specified previously in this application. The annealing operation may be continuous as in resistance annealing, induction annealing, convection annealing by continuous furnaces or radiation annealing by continuous furnaces, or, preferably, may be batch annealed in a batch furnace. When continuously annealing, the temperatures of about 450°F to about 1200°F may be employed with annealing times of about five minutes to about 1/10,000 of a minute. Generally, however, continuous annealing temperatures and times may be adjusted to meet the requirements of the particular overall processing operation so long as the desired physical properties are achieved. In a batch annealing operation, a temperature of approximately 400°F to about 750°F is employed with resistance times of about 30 minutes to about 24 hours. As mentioned with respect to continuous annealing, in batch annealing the times and temperatures may be varied to suit the overall process so long as the desired physical properties are obtained.

It has been found that the properties of a Number 10 gauge (American Wire Gauge) fully annealed soft wire of the present alloy vary between the follinging figures:

| Conductivity | Yield Strength, psi |
|---|---|
| 61 – 63+% | 8,000 – 18,000 |

EXAMPLE NO. 1

Various melts were prepared by adding the required amount of alloying elements to 1816 grams of molten aluminum, containing less than 0.10% trace element impurities, to achieve a percentage concentration of elements as shown in the accompanying table; the remainder being aluminum. Graphite crucibles were used except in those cases where the alloying elements were known carbide formers, in which cases aluminum oxide crucibles were used. The melts were held for sufficient times and at sufficient temperatures to allow complete solubility of the alloying elements with the base aluminum. An argon atmosphere was provided over the mold to prevent oxidation. Each melt was cast in a static mold and immediately hot-rolled through a rolling mill to 3/8 inch continuous rod. Wire was then drawn from the rod and annealed for five hours at 650°F (soft [annealed] wire from hard [as rolled] rod). The final wire diameter obtained was 0.1019 incers, 10 gauge AWG.

The types of alloys employed and the results of the tests performed thereon are as follows:

TABLE 1

| Ce | Fe | Yield Strength | %IACS |
|---|---|---|---|
| .20 | 1.00 | 12,200 | 62,50 |
| .80 | .70 | 12,600 | 62.95 |
| 1.00 | .60 | 12,800 | 63.30 |

TABLE 1-continued

| Ce | Fe | Yield Strength | %IACS |
|---|---|---|---|
| 1.50 | .55 | 13,300 | 63.86 |

%IACS = Conductivity in Percentage IACS

EXAMPLE NO. 2

An additional alloy melt was prepared according to Example 1 so that the composition was as follows in weight percent:

| | |
|---|---|
| Cerium | 0.60% |
| Iron | 0.70% |
| Mangnesium | 0.15% |
| Aluminum | Remainder. |

The melt was processed to a No. 10 gauge soft wire. The physical properties of the wire were as follows:

| | |
|---|---|
| Yield Strength | 13,200 psi |
| Conductivity | 63.10% IACS |

EXAMPLE NO. 3

An additional alloy melt was prepared according to Example No. 1 so that the composition was as follows in weight percent:

| | |
|---|---|
| Cerium | 0.40% |
| Iron | 1.10% |
| Aluminum | Remainder. |

The melt was processed to a No. 10 gauge soft wire. The physical properties of the wire were as follows:

| | |
|---|---|
| Yeild Strength | 12,400 psi |
| Conductivity | 62.50% IACS |

EXAMPLE NO. 4

An additional alloy melt was prepared according to Example No. 1 so that the composition was as follows in weight percent:

| | |
|---|---|
| Cerium | 1.50% |
| Iron | 0.55% |
| Aluminum | Remainder. |

The melt was processed to a No. 10 gauge soft wire. The physical properties of the wire were as follows:

| | |
|---|---|
| Yield Strength | 12,900 psi |
| Conductivity | 63,40% IACS |

Through testing and analysis of an alloy containing 0.80 weight percent cerium, 0.55 weight percent iron, and the remainder aluminum, it has been found that the present aluminum base alloy after cold working includes intermetallic compound precipitates.

One of the compounds is identified as cerium aluminate ($CeAl_4$) and the other is identified as iron aluminate ($FeAl_3$). The cerium intermetallic compound is found to be very stable and especially so at high temperatures. Upon examination of the cerium intermetallic compound precipitate in a cold drawn wire, it is found that the precipitate is oriented in the direction of drawing. In addition, it is found that the precipitate can be rod-like, plate-like, or spherical in configuration.

The iron aluminate intermetallic compound contributes to the pinning of dislocation sites during cold working of the wire. Upon examination of the iron intermetallic compound precipitate in a cold drawn wire, it is found that the precipitates are substantially evenly distributed through the alloy and have a particles size of less than 1 micron. If the wire is drawn without any intermediate anneals, the particle size of the iron intermetallic compounds is less than 2,000 angstroms.

It has been found that the aluminum alloy wire of the present invention has a characteristic of thermal stability which exceeds the thermal stability of conventional aluminum alloy wires.

For the purpose of clarity, the following terminology used in this application is explained as follows:

Aluminum alloy rod — A solid product that is long in relation to its cross-section. Rod normally has a cross-section of between three inches and 0.375 inches.

Aluminum alloy wire — A solid wrought product that is long in relation to its cross-section, which is square or rectangular with sharp or rounded corners or edges, or is round, a regular hexagon or a regular octagon, and whose diameter or greatest perpendicular distance between parallel faces is between 0.374 inches and 0.0031 inches.

While this invention has been described in detain with particular reference to preferred embodiments thereof, it will be understood that variations and modifications can be effected within the spirit and scope of the invention as described hereinbefore and as defined in the appended claims.

What is claimed:

1. An aluminum alloy electrical conductor manufactured in the form of an at least partially annealed wire by means of continuous casting and rolling, drawing without preliminary or intermediate anneals, and then at least partially annealing the wire, said wire having a minimum conductivity of 61% IACS in the final at least partially annealed condition and consisting essentially of from about 0.55 to about 1.2 weight percent iron, from about 0.2 to about 1.5 weight percent cerium, optionally up to about 0.15 weight percent each of cobalt and magnesium in a total amount not exceeding about 0.25 weight percent, and the remainder aluminum with associated trace elements, the combined amounts of cerium and iron ranging from at least about 1.2 percent to about 2.5 percent; said wire having dispersed therein intermetallic precipitates comprising cerium aluminate and iron aluminate to further improve the physical properties of said conductor.

2. The aluminum alloy electrical conductor according to claim 1, wherein iron is present in an amount ranging from about 0.65 to about 1.0 percent, and cerium is present in an amount ranging from about 0.3 percent to about 1.0 percent.

3. The aluminum alloy electrical conductor according to claim 2, wherein the cerium aluminate precipitated compounds are oriented in the direction of drawing.

4. The aluminum alloy electrical conductor according to claim 1, said conductor being in the form of a fully annealed wire having a yield strength in excess of 8,000 psi.

5. The aluminum alloy electrical conductor according to claim 1, wherein the weight percentages of the constituents are as follows:

| | |
|---|---|
| cerium | 0.60 percent |
| iron | 0.70 percent |
| magnesium | 0.15 percent |
| aluminum | remainder. |

6. The aluminum alloy electrical conductor according to claim 1, wherein the weight percentages of the constituents are as follows:

| | |
|---|---|
| cerium | 0.80 percent |
| iron | 0.70 percent |
| aluminum | remainder. |

7. The aluminum alloy electrical conductor according to claim 1, wherein the weight percentages of the constituents are as follows:

| | |
|---|---|
| cerium | 1.0 percent |
| iron | 0.60 percent |
| aluminum | remainder. |

8. The aluminum alloy electrical conductor according to claim 1, wherein the weight percentages of the constituents are as follows:

| | |
|---|---|
| cerium | 0.40 percent |
| iron | 1.0 percent |
| aluminum | remainder. |

9. The aluminum alloy electrical conductor according to claim 1, wherein the weight percentages of the constituents are as follows:

| | |
|---|---|
| cerium | 1.50 percent |
| iron | 0.55 percent |
| aluminum | remainder. |

10. A method of preparing the aluminum alloy electrical conductor according to claim 1, comprising the steps of:

A. alloying said named constituents;

B. continuously casting the alloy in a moving mold formed between a groove in the periphery of a rotating casting wheel and a metal belt laying adjacent said groove for a portion of its length;

C. hot-rolling the cast alloy substantially immediately after casting while the cast alloy is in substantially that condition as cast to form a continuous rod;

D. drawing the rod through a series of wire-drawing dies, without any preliminary or intermediate anneals, to form wire; and E. thereafter annealing or partially annealing the wire to achieve a conductivity of at least 61% IACS.

* * * * *